United States Patent [19]

Stuart

[11] 4,238,211

[45] Dec. 9, 1980

[54] METHOD OF EMPLOYING A FIRST CONTAMINANT TO PREVENT FREEZE-OUT OF A SECOND CONTAMINANT DURING CRYOGENIC PROCESSING OF A GASEOUS STREAM

[75] Inventor: Robert W. Stuart, Kinderhook, N.Y.

[73] Assignee: Helix Technology Corporation, Waltham, Mass.

[21] Appl. No.: 962,255

[22] Filed: Nov. 20, 1978

[51] Int. Cl.[2] ..... F25J 3/00

[52] U.S. Cl. ..... 62/20; 62/21; 62/18; 62/24

[58] Field of Search ..... 62/20, 21, 23–28

[56] References Cited

U.S. PATENT DOCUMENTS

| | | | |
|---|---|---|---|
| 1,529,625 | 3/1925 | Rafferty et al. | 62/28 |
| 1,664,412 | 4/1928 | Haynes | 62/28 |
| 3,218,816 | 11/1965 | Grenier | 62/28 |
| 3,407,614 | 10/1968 | Poska | 62/23 |
| 3,735,600 | 5/1973 | Dowdell et al. | 62/26 |
| 3,899,312 | 8/1975 | Kruis et al. | 62/20 |

*Primary Examiner*—Norman Yudkoff

*Attorney, Agent, or Firm*—Hamilton, Brook, Smith & Reynolds

[57] ABSTRACT

In the cryogenic processing of a gaseous stream, the level of a first contaminant is adjusted, such as by recycling first contaminant already removed or by adding first contaminant, to maintain the total concentration of first contaminant in the gaseous stream at a level sufficient to dissolve the total amount of a second contaminant which would otherwise freeze-out, whereby the likelihood of freeze-out of the second contaminant is substantially reduced during cooling of the gaseous stream to cryogenic processing temperatures.

5 Claims, 1 Drawing Figure

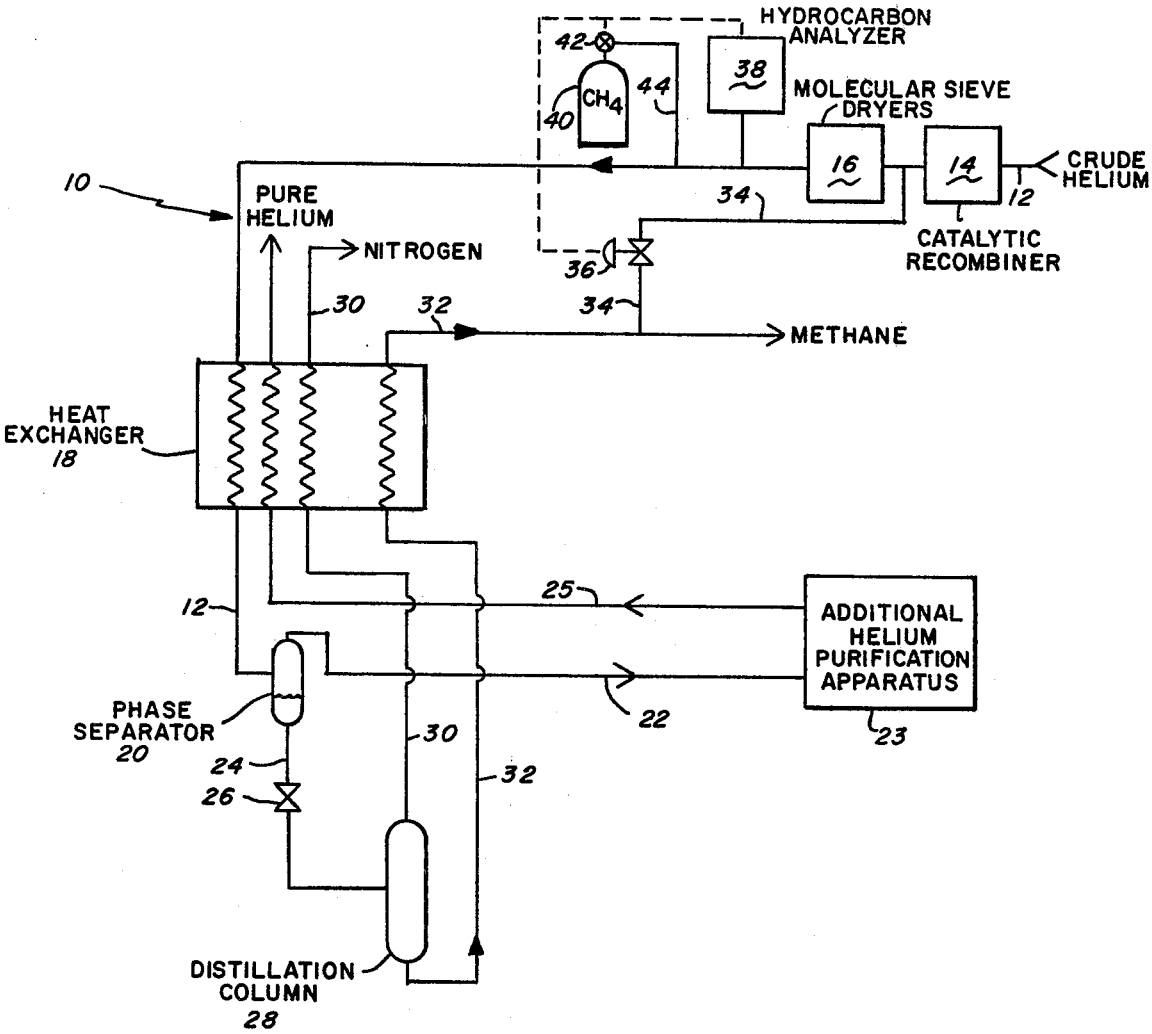
HYDROCARBON ANALYZER
38
42
CH4
40
44
MOLECULAR SIEVE DRYERS
16
14
CRUDE HELIUM
12
34
CATALYTIC RECOMBINER
10
PURE HELIUM
NITROGEN
36
30
32
34
METHANE
HEAT EXCHANGER 18
12
25
ADDITIONAL HELIUM PURIFICATION APPARATUS
22
23
PHASE SEPARATOR 20
24
26
30
32
DISTILLATION COLUMN 28

METHOD OF EMPLOYING A FIRST CONTAMINANT TO PREVENT FREEZE-OUT OF A SECOND CONTAMINANT DURING CRYOGENIC PROCESSING OF A GASEOUS STREAM

BACKGROUND OF THE INVENTION

1. Field of the Invention

This invention is in the field of cryogenic processing systems.

2. Description of the Prior Art

The problems caused by water or other materials freezing in refrigeration equipment have long been recognized. For example, in U.S. Pat. No. 167,181, the problem of the clogging action of pure ammoniacal gas when such gas meets oil or other lubricating materials in icemaking machines or refrigerators is pointed out. It is pointed out that a viscous deposit which coats and clogs the pipes, and often caused partial or complete stoppages was often the result. To solve this problem, this patent teaches that the addition of 5 to 10% of benzene, or other hydrocarbon vapor, neutralized this problem.

U.S. Pat. Nos. 2,163,899 and 2,163,900 both deal with a similar problem in refrigeration equipment employing hydrocarbon halide refrigerants. These patents teach that certain organic ether compounds and organic acetate or ketone compounds, respectively, could be added in amounts of up to 10% to prevent the formation of ice crystals or to remove ice crystals already formed in hydrocarbon halide refrigerants.

Methanol has also been used in hydrocarbon gas streams to prevent hydrate and ice formation. An example of the use of methanol in such systems is described in U.S. Pat. No. 3,644,107 wherein the methanol is first conditioned by vaporizing it, and subsequently injected into such hydrocarbon streams for this purpose.

Freeze-out of a gas component is particularly a problem in systems wherein the gas mixture will be subjected to extremely low temperatures, e.g., cryogenic temperatures. Such temperatures are encountered, for example, in the separation or purification of certain gas mixtures by total liquefaction of the gas mixture. For example, a method for purifying a natural gas stream rich in carbon dioxide is disclosed in U.S. Pat. No. 3,306,057. In this method, a natural gas mixture containing a substantial amount of carbon dioxide is purified by a process of: (a) cooling the compressed stream in a system which includes a first heat exchanger charged with cold carbon dioxide and condensing it to a liquid; (b) fractionating the liquid to yield substantially pure liquid carbon dioxide and a methane-rich gas; (c) partially condensing the methane-rich gas in a second heat adsorber charged with cold carbon dioxide, recompressing, chilling and expanding the gaseous faction to separate out contaminating carbon dioxide as a solid; and (d) combining the solid carbon dioxide with the liquid bottoms from the fractionator reboiler and using the combined medium as coolant in the aforesaid heat adsorbers.

Although freeze-out of a contaminant from a gas stream has almost universally been considered a deleterious phenomenum, the teachings of U.S. Pat. No. 3,885,939 seem to suggest that contaminant freeze-out can be used to advantage. In this patent, a cryostat flow control in which the refrigerant flow rate is controlled by the addition of a contaminant or foreign fluid to the refrigerant is described. After initial cool-down, the contaminant, having a higher solidification point than the refrigerant, will solidify in the cryostat and cause partial or complete refrigerant flow stoppage. When the refrigerant flow is reduced or stopped, refrigeration slows or ceases with a resultant rise in cryostat temperature, which in turn then melts the solidified contaminant. Refrigerant flow will then resume until the temperature is again reduced to freeze-up or solidify the refrigerant contaminant.

Despite the teachings of U.S. Pat. No. 3,885,939, contaminant freeze-out is a very serious problem in most cryogenic systems and various methods have been devised to deal with this problem. Thus, in U.S. Pat. No. 3,282,059, an apparatus for dealing with this problem in the liquefaction of natural gas containing carbon dioxide and water vapor as impurities is taught. The solution taught by this patent is the provision of two parallel heat exchangers which allows the gaseous stream to be circulated to a second heat exchanger after the first has become coated or caked by the adherence of solid impurities. The clogged heat exchanger is then flushed with a natural gas stream which is then refed to the feed stream.

In U.S. Pat. No. 3,793,846, a Stirling cycle refrigerator apparatus is disclosed which includes a contaminant adsorber positioned in the cold portion of the refrigerator and connected to selectively transmit gas to the cold side of the refrigerator so that the regenerator is purged with relatively warm gas from the adsorber.

The problems caused by contaminant freeze-out are particularly severe in the cryogenic processing of a gaseous helium stream. In a typical helium feed stream, there are many impurities, such as neon, nitrogen, hydrogen, methane, ethane, propane, butanes, pentanes, hexanes, carbon dioxide and heavier hydrocarbons. Some of the hydrocarbons, such as methane, for example, are typically removed in the preprocessing of the helium stream prior to its final purification which involves very low cryogenic temperatures to remove remaining contaminants such as carbon dioxide. Unfortunately, reducing the level of hydrocarbons in the preprocessing often aggravates $CO_2$ freeze-out problems since some hydrocarbons can act as solvents for $CO_2$.

SUMMARY OF THE INVENTION

This invention relates to the cryogenic processing of gaseous streams which contain at least two contaminants. A first contaminant is one which acts as a solvent for a second contaminant, and the second contaminant is one which would normally freeze-out when the gaseous stream is reduced to the cryogenic processing temperatures. In the processing, the level of the first contaminant is reduced to a concentration which is insufficient to dissolve substantially all of the second contaminant. Thereafter, the gaseous stream is cooled to a cryogenic temperature at which freeze-out of the second contaminant would normally occur.

The improvement of this invention comprises adding to the gaseous stream prior to its cooling to a cryogenic temperature at which freeze-out of the second contaminant would occur, an amount of the first contaminant to raise the level of the first contaminant to a concentration in the gaseous stream sufficient to dissolve substantially all of the second contaminant. By this means, the second contaminant is contained in a dissolved state in the first component which reduces the likelihood of its freezing out during cryogenic processing of the gaseous stream.

These conditions might be present, for example, in the purification of a gaseous helium stream which contains, as contaminants, both a hydrocarbon, such as methane, and carbon dioxide. Since methane is a solvent for carbon dioxide up to certain concentrations of the latter, a supplemental amount of methane can be added to the incoming helium stream to maintain the concentration of methane above a level sufficient to keep the carbon dioxide dissolved. This can be conveniently done by recycling some of the methane separated in the preprocessing of the feed helium stream.

If methane is not present initially, an amount can be added which is sufficient to dissolve the carbon dioxide present.

This invention comprises, therefore, an extremely efficient method of reducing the likelihood of freeze-out of certain contaminants in gaseous streams by making only minor modifications to the process flow paths previously employed.

BRIEF DESCRIPTION OF THE DRAWING

The FIGURE illustrates schematically a typical helium purification system employing the invention described herein.

DESCRIPTION OF PREFERRED EMBODIMENT

The invention can be more specifically described by reference to the FIGURE in which helium purifier system 10 is shown. In such a purifier, crude helium is processed to reduce significantly the level of contaminants therein.

Crude helium feed stream 12 is fed to catalytic recombiner 14 to reduce the level of hydrogen. Catalytic recombiner 14 might contain a catalyst such as palladium, platinum, other precious metals, etc. Subsequently, feed stream 12 is directed to molecular sieve driers 16 to remove water and some of the carbon dioxide contaminant. At this point, feed stream 12 is directed into heat exchanger 18 which has a typical plate and fin design. Feed stream 12 is significantly cooled in heat exchanger 18 by the countercurrent flow of pure helium, nitrogen and methane separated as described herein.

After exiting from heat exchanger 18, feed stream 12 is introduced to phase separator 20. Phase separator 20 has a gaseous stream 22 exiting from its top which contains chilled partially purified helium. This is further purified in additional helium purification apparatus 23 and directed in line 25 back to heat exchanger 18 to assist in cooling crude helium feed. The liquid remaining in phase separator 20 contains methane and nitrogen and exits from the bottom of separator 20 through line 24 and the flow rate can be controlled by flow control valve 26. This liquid portion is fed by line 24 into distillation column 28. Pure nitrogen remaining in the liquid flashes and exits from the top of column 28 and is recycled through heat exchanger 18 in line 30 to help in coolin inlet feed. The bottom product from column 28 is essentially pure methane which is directed by line 32 through heat exchanger 18 where it also assists in cooling inlet stream 12.

Recycle line 34 and solenoid control valve 36 serve to provide a recycle capability for part of the separated methane. In practice, a hydrocarbon analyzer 38 might be used to sense the methane content in the feed stream after the preprocessing in catalytic recombiner 14 and molecular sieves 16. If the level of methane is below that which would be sufficient to dissolve any remaining carbon dioxide at this point, analyzer 38 transmits a signal to solenoid valve 36 which is then opened to allow a portion of pure methane in line 32 to be recycled into feed stream 12. Thus, the level of methane can be maintained sufficient in the feed purifier 10 to substantially reduce the likelihood of carbon dioxide freeze-out in heat exchanger 18 or at other points.

If no methane is present in the crude helium feed, or an insufficient amount, pure methane can be introduced from methane cannister 40. The amount can be controlled by valve 42, which acts in response to a signal from hydrocarbon analyzer 38, and the metered amount is introduced via line 44.

Although this invention has been discussed in terms of a helium stream containing methane and carbon dioxide as contaminants, many other gaseous streams containing other contaminants could be used. For example, the gaseous stream might be natural gas, hydrogen, nitrogen, or air. Similarly, first contaminants might be oxygen, nitrogen or ethane, etc. The second components might be carbon dioxide, acetylene, hydrogen sulfide or heavy hydrocarbons.

Those skilled in the art will recognize many other equivalents to those specifically desired herein. Such equivalents are intended to be encompassed within the scope of the following appended claims.

What is claimed is:

1. In the cryogenic processing of a gaseous stream containing a first contaminant and a second contaminant, said first contaminant being a solvent for said second contaminant and said second contaminant being one which will freeze out of the gaseous stream at cryogenic temperatures, said processing including the steps of reducing the concentration of the first contaminant to a level which is insufficient to dissolve substantially all of the second contaminant at said cryogenic temperatures and subsequently cooling said gaseous stream to cryogenic temperatures whereby freeze-out of said second component would normally occur:

The improvement of analyzing the proportions of the first contaminant to the second contaminant and adding to the gaseous stream prior to cooling it to said cryogenic temperatures a supplemental amount of said first contaminant to raise the level of said first contaminant in the gaseous stream if the concentration of the first contaminant is insufficient to dissolve substantially all of said second component at said cryogenic temperatures thereby reducing the likelihood of freeze-out of said second component during processing of the gaseous stream.

2. The improvement of claim 1 wherein said gaseous stream comprises helium.

3. The improvement of claim 2 wherein said second contaminant comprises carbon dioxide.

4. The improvement of claim 3 wherein said first contaminant comprises a hydrocarbon.

5. The improvement of claim 4 wherein said first contaminant comprises methane.

* * * * *